US008888603B2

(12) United States Patent
Sato et al.

(10) Patent No.: US 8,888,603 B2
(45) Date of Patent: Nov. 18, 2014

(54) SWING ANALYZER AND GOLF CLUB SHAFT SELECTING SYSTEM

(75) Inventors: Fuminobu Sato, Osaka (JP); Hiroshi Nagao, Osaka (JP); Takashi Kimura, Osaka (JP)

(73) Assignee: Mizuno Corporation, Osaka (JP)

( * ) Notice: Subject to any disclaimer, the term of this patent is extended or adjusted under 35 U.S.C. 154(b) by 1518 days.

(21) Appl. No.: 12/508,166

(22) Filed: Jul. 23, 2009

(65) Prior Publication Data

US 2010/0210371 A1 Aug. 19, 2010

(30) Foreign Application Priority Data

Feb. 16, 2009 (JP) ..... 2009-032805

(51) Int. Cl.

| | |
|---|---|
| ***A63B 69/36*** | (2006.01) |
| ***G01N 3/00*** | (2006.01) |
| ***A63B 59/00*** | (2006.01) |
| *A63B 24/00* | (2006.01) |

(52) U.S. Cl.

CPC ..... *A63B 59/0074* (2013.01); *A63B 2024/0028* (2013.01); *A63B 2220/51* (2013.01); *A63B 2220/806* (2013.01); *A63B 2220/16* (2013.01); *A63B 2220/30* (2013.01); *A63B 2059/0003* (2013.01); *A63B 2220/807* (2013.01); *A63B 2220/40* (2013.01); *A63B 2225/50* (2013.01); *A63B 2024/0034* (2013.01)

USPC ..... 473/223

(58) Field of Classification Search

CPC ..... G01L 1/10; G01L 1/18; G01L 1/22; G01L 1/2206; G01L 1/2212; G01L 1/2287; G01L 5/0019; G01L 5/162; G01L 5/167; G01L 1/16; G01L 1/183; G01L 1/20; G01L 9/04; G01B 7/15; G01B 7/063; G01G 3/13; A63B 53/04; A63B 53/10; A63B 53/12; A63B 59/0074; A63B 69/3632; A63B 69/3685; A63B 2220/51; A63B 2024/0028; A63B 2220/30; A63B 2225/50; A63B 2059/0003; A63B 2220/807; A63B 2220/16; A63B 2220/806; A63B 2024/0034

USPC ..... 473/282, 219, 212, 222, 223, 226, 233, 473/242, 257, 260; 434/252; 73/1.15, 760, 73/781, 782, 789, 794, 795, 862.044, 73/862.045, 862.338, 862.474, 862.627

See application file for complete search history.

(56) References Cited

U.S. PATENT DOCUMENTS 4,157,181 A * 6/1979 Cecka ..... 473/319
5,821,417 A 10/1998 Naruo et al.

(Continued)

FOREIGN PATENT DOCUMENTS

JP WO96/11726 4/1996
JP 10-043332 2/1998

(Continued)

OTHER PUBLICATIONS

Machine translation of JP 11-178952 A, application JP 09-351070, downlaoded from http://dossier1.ipdl.inpit.go.jp on Oct. 4, 2013.*

(Continued)

*Primary Examiner* — David L Lewis
*Assistant Examiner* — Matthew D Hoel
(74) *Attorney, Agent, or Firm* — Troutman Sanders LLP; James E. Schutz; Daniel Sharpe

(57) ABSTRACT

A measuring device includes a strain gauge, a processing unit calculating an expected bending point value corresponding to a bending point position, and a display unit capable of displaying an output value from the processing unit. The processing unit calculates the expected bending point value based on a measured value of strain gauge at a first time point during a swing of the user and a measured value of strain gauge at a second time point closer to an impact time point than the first time point. The processing unit stores in advance conversion data for converting the expected bending point value to recommended kick point output value indicating kick point, and the processing unit outputs the recommended kick point output value corresponding to the calculated expected bending point value to the display unit.

3 Claims, 13 Drawing Sheets

(56) References Cited

U.S. PATENT DOCUMENTS

| | | | | |
|---|---|---|---|---|
| 6,000,286 | A | 12/1999 | Naruo et al. | |
| 6,003,368 | A | 12/1999 | Naruo et al. | |
| 6,014,887 | A | 1/2000 | Naruo et al. | |
| 6,041,651 | A | 3/2000 | Naruo et al. | |
| 6,213,888 | B1 * | 4/2001 | Kawaguchi et al. | 473/223 |
| 6,402,634 | B2 * | 6/2002 | Lee et al. | 473/223 |
| 2006/0211510 | A1 * | 9/2006 | Ashida et al. | 473/316 |

FOREIGN PATENT DOCUMENTS

| | | |
|---|---|---|
| JP | 2001-070482 | 3/2001 |
| JP | 2003-205053 | 7/2003 |
| JP | 2003-284802 | 10/2003 |
| JP | 2004-129687 | 4/2004 |
| JP | 2006-289073 | 10/2006 |

OTHER PUBLICATIONS

Machine translation of JP 10-043332 A, application JP 08-209912, downlaoded from http://dossier1.ipdl.inpit.go.jp on Oct. 4, 2013.*

Machine translation of JP 2000-079186 A, application JP 10-267235, downlaoded from http://dossier1.ipdl.inpit.go.jp on Oct. 4, 2013.*

Machine translation of JP 2003-205053 A, application JP 2002-005944, downlaoded from http://dossier1.ipdl.inpit.go.jp on Oct. 4, 2013.*

Machine translation of JP 2001-190711 A, application JP 2000-006496, downlaoded from http://dossier1.ipdl.inpit.go.jp on Oct. 4, 2013.*

Machine translation of JP 2003-284802 A, application JP 2002-092501, downlaoded from http://dossier1.ipdl.inpit.go.jp on Oct. 4, 2013.*

Machine translation of JP 3243209 B, application JP 09-351070, downlaoded from http://dossier1.ipdl.inpit.go.jp on Oct. 4, 2013.*

Machine translation of JP 2006-289073 A, application JP 2006-076548, downlaoded from http://dossier1.ipdl.inpit.go.jp on Oct. 4, 2013.*

Machine translation of JP 2004-129687 A, application JP 2002-294531, downlaoded from http://dossier1.ipdl.inpit.go.jp on Oct. 4, 2013.*

Machine translation of JP 2001-070482 A, application JP 11-246452, downlaoded from http://dossier1.ipdl.inpit.go.jp on Oct. 4, 2013.*

Machine translation of JP 11-178953 A, application JP 09-351071, downlaoded from http://dossier1.ipdl.inpit.go.jp on Oct. 4, 2013.*

Machine translation of JP 3243210 B, application JP 09-351071, downlaoded from http://dossier1.ipdl.inpit.go.jp on Oct. 4, 2013.*

"The Static and Dynamic Stiffness Behaviour of Composite Golf Shafts and Their Constituent Materials," Betzler, et al., Sports Engineering, 2011, 14:27-37, downloaded from link.springer.com Jul. 30, 2014.*

"A Three-Dimensional Forward Dynamics Model of the Gofl Swing," MacKenzie, et al., Sports Engineering, 2009, 11:165-175, downloaded from link.springer.com Jul. 30, 2014.*

"Understanding the Mechanisms of Shaft Deflection in the Gofl Swing," MacKenzie, et al., Sports Engineering, 2010, 12:69-75, downloaded from link.springer.com Jul. 30, 2014.*

"Understanding the Role of Shaft Stiffness in the Golf Swing," MacKenzie, et al., Sports Engineering, 2009, 12:13-19, downloaded from link.springer.com Jul. 30, 2014.*

Decision to Grant Patent for Patent Application No. 2009-032805, certified Apr. 5, 2011.

* cited by examiner

SWING ANALYZER AND GOLF CLUB SHAFT SELECTING SYSTEM

This nonprovisional application is based on Japanese Patent Application No. 2009-032805 filed with the Japan Patent Office on Feb. 16, 2009, the entire contents of which are hereby incorporated by reference.

BACKGROUND OF THE INVENTION

1. Field of the Invention

The present invention relates to a swing analyzer and a golf club shaft selecting system. More specifically, the present invention relates to a swing analyzer and a golf club shaft selecting system that support selection of a kick point suitable for a user.

2. Description of the Background Art

A golf club shaft has various characteristics, and it is necessary for a golfer to select a golf club shaft having characteristics suitable for the golfer. A golf club shaft suitable for each golfer can be selected in most cases by appropriately selecting shaft mass, flex and kick point, among various characteristics of a golf club shaft. The shaft mass, flex and kick point, however can be designed independent from each other and, therefore, there are a huge number of combinations of these characteristics. This makes it very difficult to select a suitable golf club shaft for each golfer.

A golf club shaft selecting system focusing on shaft flex (EI: bending stiffness) is described, for example, in International Publication WO96/11726. Here, measurement of swing time, swing speed (club head speed), club head acceleration or amount of shaft strain of each golfer, or measurement of head speed in addition to the items above, is disclosed.

A golf club shaft selecting system focusing on bending stiffness distribution (EI distribution) of a shaft is described, for example, in Japanese Patent Laying-Open No. 2004-129687. This solution includes: a first analysis system having shaft behavior measuring means for measuring deformation behavior of a shaft during a swing, shaft EI calculating means for calculating EI distribution of the shaft, and shaft shape calculating means for calculating deformed shape of the shaft during a swing; and a second analysis system having swing classification means for analyzing and classifying a swing by a golfer. The deformation behavior of the shaft during a swing is analyzed, and the golfer's swings are analyzed, whereby an optimal shaft for the golfer is selected.

A golf club shaft selecting system focusing on distortion stiffness (torque) of a shaft is described, for example, in Japanese Patent Laying-Open No. 2001-70482. Here, measurement of shaft strain amount during a swing of each golfer, or simultaneous measurement of strain amount and head speed is disclosed.

Another exemplary method of measuring distortion strain is disclosed in Japanese Patent Laying-Open No. 2003-205053. According to the disclosure, distortion strain generated in the shaft during a golf club swing is measured, and based on time history data of measured distortion strain, dynamic evaluation of the shaft including distortion behavior of the shaft is made.

Further, a golf club shaft selecting system focusing on toe down amount during a swing is described, for example, in Japanese Patent Laying-Open No. 2003-284802. Here, a method is disclosed, in which bending moment distribution on the shaft during a swing of a sample golf club is measured, based on the measured data and the bending stiffness distribution of the shaft, five elements including the "toe down amount," which is the amount of flexure of shaft in the direction in which the toe side of club head lowers immediately before the impact, are calculated, and based on the result of calculation, more suitable or optimal shaft for the golfer is selected.

Another exemplary method of measuring the "toe down amount" is described in Japanese Patent Laying-Open No. 10-43332. Here, use of a television camera or optical detecting means for measuring the toe down amount of a golf club is disclosed.

The conventional shaft selecting systems, however, require a high-speed camera or the like. It is impossible with a simple structure to analyze swing characteristics of a user and to select kick point suitable for the swing characteristics of the user.

SUMMARY OF THE INVENTION

The present invention was made in view of the foregoing, and its object is to provide a swing analyzer and a golf club shaft selecting system that can analyze swing characteristics of a user and select kick point suitable for the swing characteristics of the user, with a simple structure.

The present invention provides a swing analyzer capable of outputting information usable for analyzing a swing of a user swinging a golf club, including a shaft extending in a longitudinal direction and a head portion provided at one end of the shaft. It includes a toe down strain gauge provided on the shaft of the golf club and capable of measuring strain in toe down direction of the shaft; a built-in processing unit calculating an expected bending point value corresponding to a position of bending point of the shaft; and a built-in display unit capable of displaying an output value from the built-in processing unit. The built-in processing unit calculates the expected bending point value based on a measured value of the toe down strain gauge at a first time point during a swing of the user and on a measured value of the toe down strain gauge at a second time point preceding the first time point. The built-in processing unit stores in advance conversion data for converting the expected bending point value to recommended kick point output value. The recommended kick point output value is an output value representing the expected bending point value of the shaft, and the built-in processing unit outputs the recommended kick point output value corresponding to the calculated expected bending point value to the built-in display unit.

Preferably, the toe down strain gauge is provided between a position of 304 mm and a position of 381 mm from the the other end of the shaft.

Preferably, the toe down strain gauge continuously outputs measured values to the built-in processing unit. The built-in processing unit detects a time point at which ratio of fluctuation of measured values continuously output from the toe down strain gauge exceeds a prescribed value, as an impact time point. Further, the built-in processing unit sets the first time point between time points 10 ms before and 100 ms before the detected impact time point, and sets the second time point between time points 100 ms before and 200 ms before the detected impact time point.

Preferably, the analyzer further includes a ball flying direction strain gauge capable of detecting strain of the shaft in a ball flying direction. The built-in processing unit calculates maximum amount of strain of the shaft based on a measured value of the ball flying direction strain gauge and on a measured value from the toe down strain gauge. The built-in processing unit stores conversion data for converting the maximum amount of strain of the shaft to a swing tempo output value indicating swing tempo of the user, the built-in processing unit calculates the swing tempo output value based on the calculated maximum amount of strain, and the built-in display unit displays the calculated swing tempo output value.

According to another aspect, the present invention provides a swing analyzer capable of outputting information usable for analyzing a swing of a user swinging a golf club, including a shaft extending in a longitudinal direction and a head portion provided at one end of the shaft. It includes first and second acceleration sensors provided on the shaft spaced apart from each other in the longitudinal direction; a built-in processing unit capable of calculating a radius of rotation of the shaft based on outputs from the first and second acceleration sensors; and a built-in display unit displaying a result of calculation by the built-in processing unit. The built-in processing unit stores conversion data for converting the radius of rotation of the shaft to a cock angle of the user; the built-in processing unit calculates cock angle of the user from calculated speed of the head portion; and the built-in display unit displays the calculated cock angle. The golf club shaft selecting system in accordance with the present invention includes the swing analyzer described above, an external processing unit for selecting a shaft suitable for the user based on an output from the swing analyzer; and an external display unit displaying an output from the external processing unit.

By the swing analyzer and the golf club shaft selecting system in accordance with the present invention, a shaft suitable for the swing characteristics of the user can be selected, and the device and system structures can be simplified.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 13 is a graph representing correlation between a difference c in output values of strain amounts detected by two strain gauges and b/a.

DESCRIPTION OF THE PREFERRED EMBODIMENTS

The swing analyzer and the golf club selecting system in accordance with an embodiment of the present invention will be described in the following.

[First Embodiment]

Figure 1:
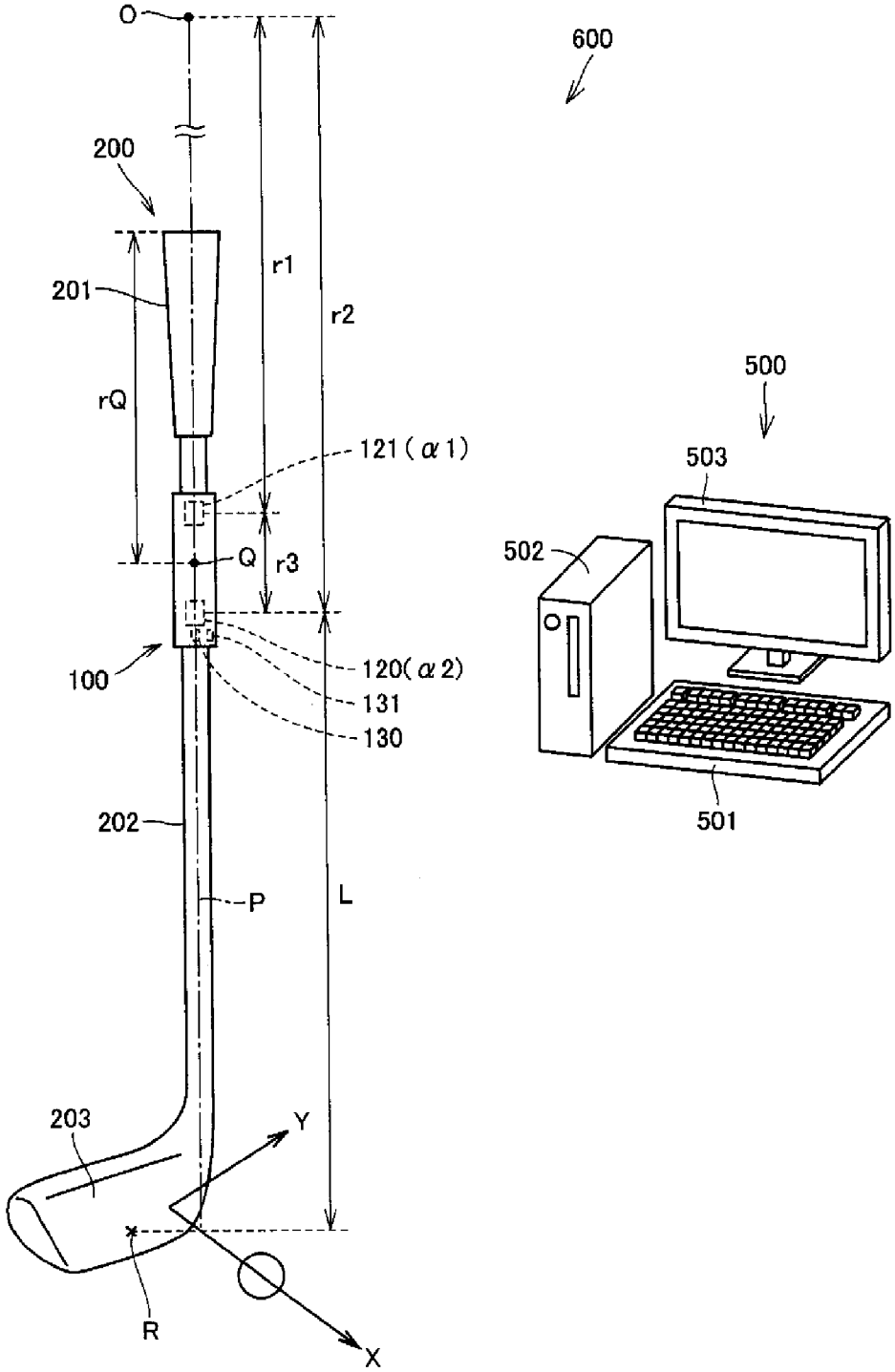
FIG. 1 is an illustration showing schematic structure of the golf club selecting system.

FIG. 1 is an illustration showing schematic structure of the golf club selecting system 600. As shown in FIG. 1, golf club selecting system 600 includes a measuring device (swing measuring device) 100 attached to a golf club 200, and an external support device 500 provided separate from measuring device 100.

Golf club 200 includes a shaft 202, a head 203 provided at one end of shaft 202, and a grip 201 provided at the other end of shaft 202.

External support device 500 includes an external processing unit 502, an external display unit 503 displaying a result of calculation by external processing unit 502, and an external input unit 501 allowing input of data and the like to external processing unit 502.

Measuring device 100 calculates "head speed" immediately before impact, "swing tempo" representing maximum amount of deflection during a swing, "kick angle" immediately before impact, "toe down amount" immediately before impact, "deflection speed" immediately before impact, and "expected bending point value e (=b/a)" calculated based on the amounts of strain at two time points during the swing, of the user.

Measuring device 100 may display the calculated "head speed," "swing tempo", "kick angle," "toe down amount," "deflection speed" and "recommended kick point output value f" calculated from the "expected bending point value e" on the display unit of measuring device 100.

The "head speed", "swing tempo," "kick angle," "toe down amount," "deflection speed" calculated by measuring device 100 and the "recommended kick point output value f" obtained by converting the "expected bending point value e" are input to external support device 500. As to the method of input, an operator may input the results displayed on the display unit of measuring device 100 using external input unit 501, or the results may automatically be input from measuring device 100 to external support device 500 through wired or wireless communication.

External support device 500 stores data for selecting "kick point" of a shaft based on the "swing tempo", data for selecting "flex" of the shaft based on the "head speed" and "swing tempo", data for setting "stiffness distribution" of the shaft based on the "toe down amount" and "kick angle" and data for selecting "shaft mass" from the "head speed."

External support device 500 calculates the kick point, flex, shaft stiffness distribution and shaft mass, based on the input data mentioned above.

Then, external support device 500 displays the selected kick point, flex and shaft mass, and displays a name of the shaft that satisfies these characteristics. Thus, a user can obtain a shaft suitable for him/her.

Measuring device 100 is attached on shaft 202 such that center of gravity Q of measuring device 100 is positioned at a portion from about 12 inches (about 304 mm) to about 15 inches (about 381 mm) from an upper end of golf club 200 (grip 201).

Weight balance of golf club 200 is attained at a position 14 inches (about 360 mm) from an end of grip 201, and even if a weight is mounted at this portion, the weight balance of golf club 200 as a whole is not much influenced.

By mounting measuring device 100 at such a position, significant variation in characteristic of golf club 200 before and after mounting measuring device 100 can be prevented.

Figure 2:
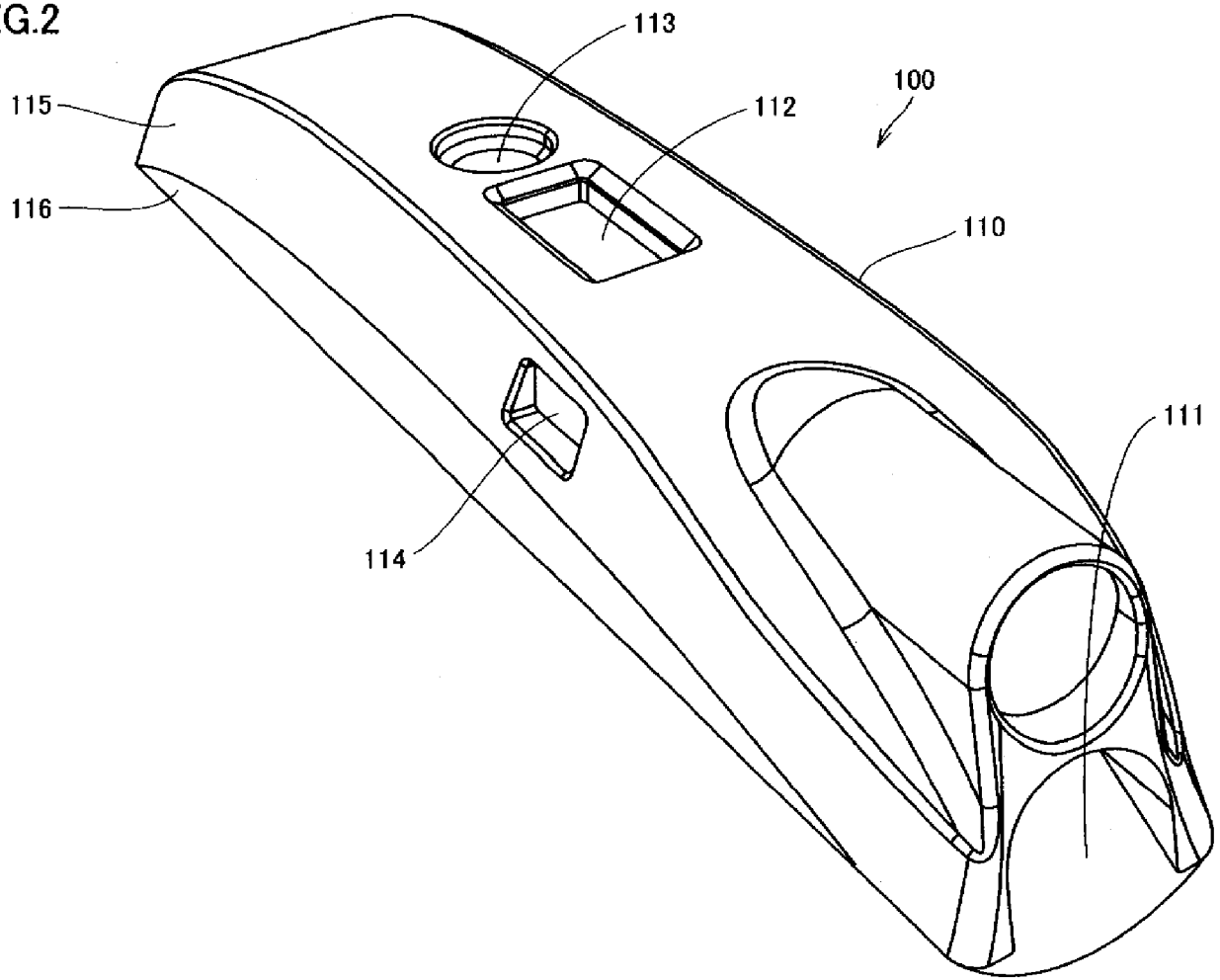
FIG. 2 is a perspective view of the measuring device.
Figure 3:
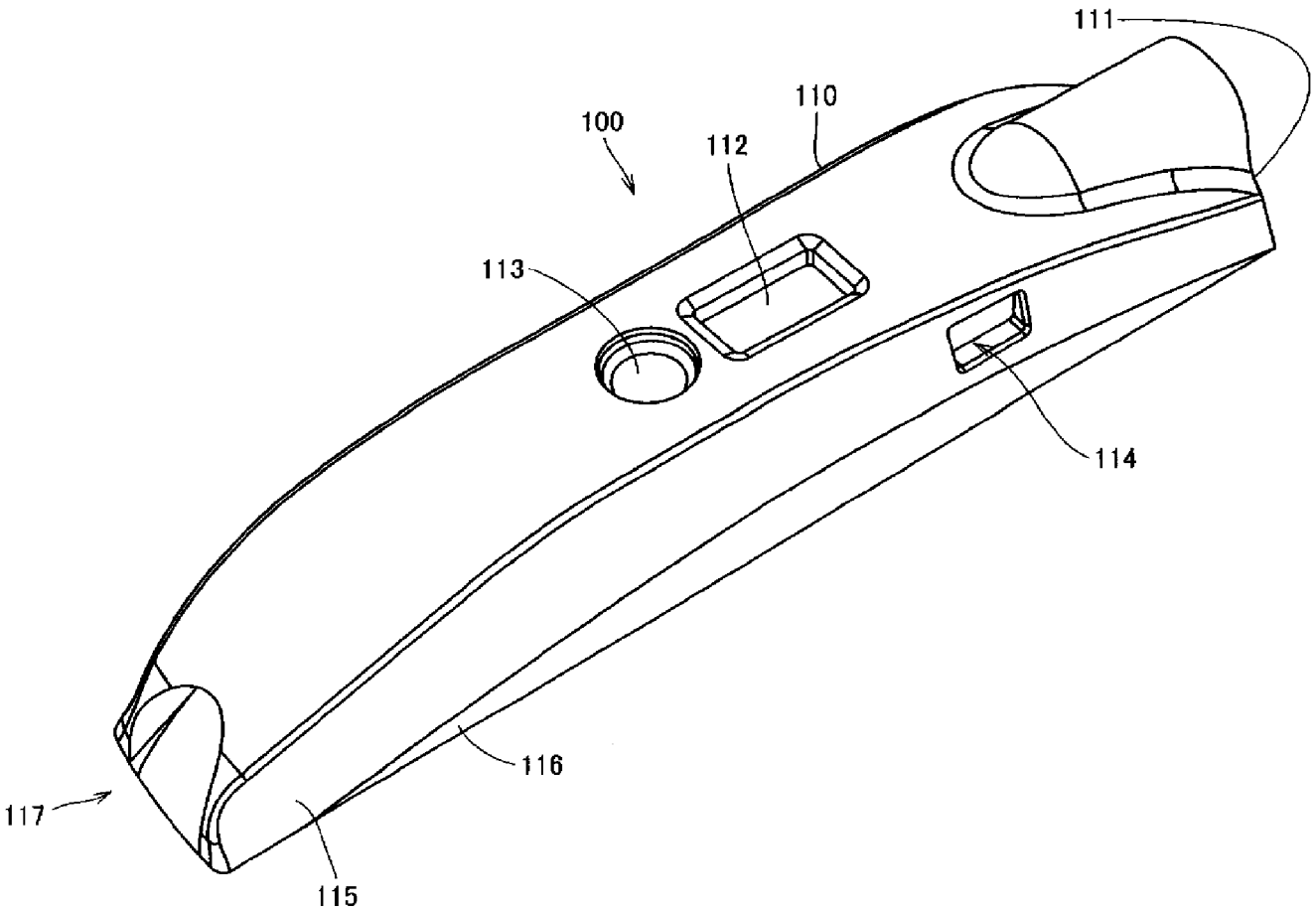
FIG. 3 is a perspective view of the measuring device.

FIGS. 2 and 3 are perspective views of measuring device 100. As shown in FIGS. 2 and 3, measuring device 100 includes a case 110 containing an acceleration sensor, strain gauge or the like therein, a display unit 112 displaying head speed and the like, a power switch 114 and a reset button 113. Case 110 includes an upper casing 115 and a lower casing 116, and by upper and lower casings 115 and 116, insertion holes 111 and 117 are defined, through which holes the shaft 202 of golf club 200 is inserted. Inner diameters of insertion holes 111 and 117 are formed to be larger than the outer diameter of shaft 202, so that even if shaft 202 should deflect during a swing, shaft 202 will not be in contact with inner circumferential surfaces of insertion holes 111 and 117.

As shown in FIG. 1, measuring device 100 includes two strain gauges, that is, a strain gauge (strain gauge for ball flying direction) 130 and a strain gauge (strain gauge for toe down) 131, provided inside a case 110.

Figure 4:
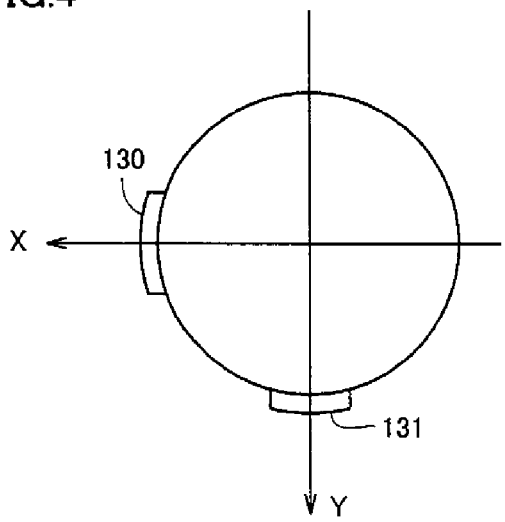
FIG. 4 is a plan view schematically showing a state of arrangement of strain gauges.

FIG. 4 is a plan view from an axial direction of shaft 202, schematically showing arrangement of strain gauges 130 and 131. As shown in FIG. 4, strain gauge 130 is adhered on a portion vertical to the ball flying direction (X-axis direction) while strain gauge 131 is adhered on a portion vertical to the direction (Y-axis direction) orthogonal to the ball flying direction, on the circumferential surface of shaft 202. Preferably, strain gauges 130 and 131 are mounted at a position of about 12 inches (about 304 mm) to about 15 inches (about 381 mm) from the grip-side end, and more preferably, at a position of about 14 inches (about 360 mm) from the grip-side end.

Strain gauges 130 and 131 are arranged apart by 90° in the circumferential direction of shaft 202.

Figure 5:
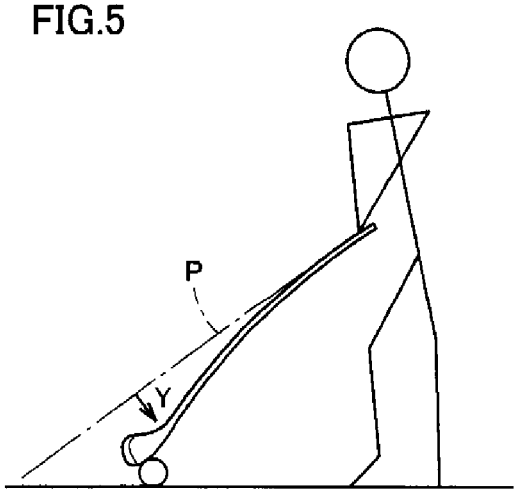
FIG. 5 is a schematic illustration showing a golf player about to hit a ball, viewed from the ball flying direction.
Figure 6:
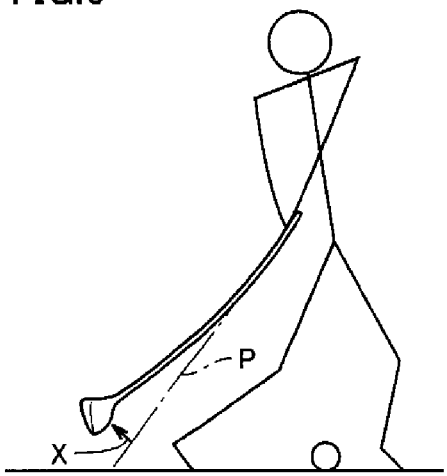
FIG. 6 is a schematic illustration showing a golf player about to hit a ball, viewed from one side.

FIGS. 5 and 6 show a golf player about to hit a ball. FIG. 5 shows the state from ball flying direction, and FIG. 6 from a side. As shown in FIG. 5, during a swing of golf club 200, when golf club 200 is brought down, a tip end of shaft 202 and head 203 trail down because of centrifugal force, from a central axial line P of shaft 202. The direction of trailing down (Y-axis direction) will be referred to as "toe down direction."

Strain gauge 131 measures strain in the Y-axis direction (toe down direction) at the position where strain gauge 131 is attached, of shaft 202. Strain gauge 130 measures strain in the X-axis direction (ball flying direction) at the position where strain gauge 130 is attached, of shaft 202.

Figure 7:
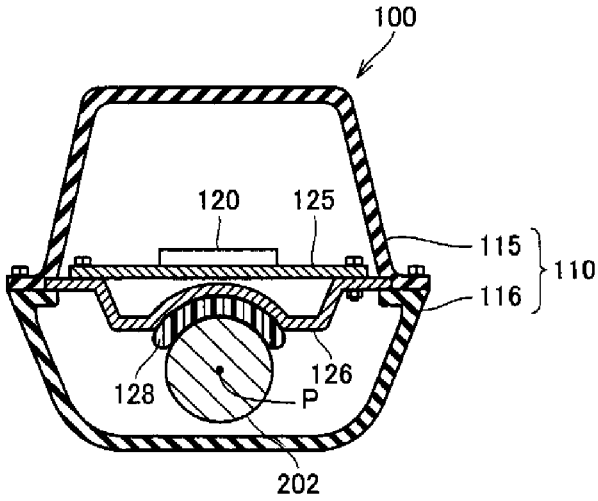
FIG. 7 is a cross-sectional view of the measuring device.
Figure 8:
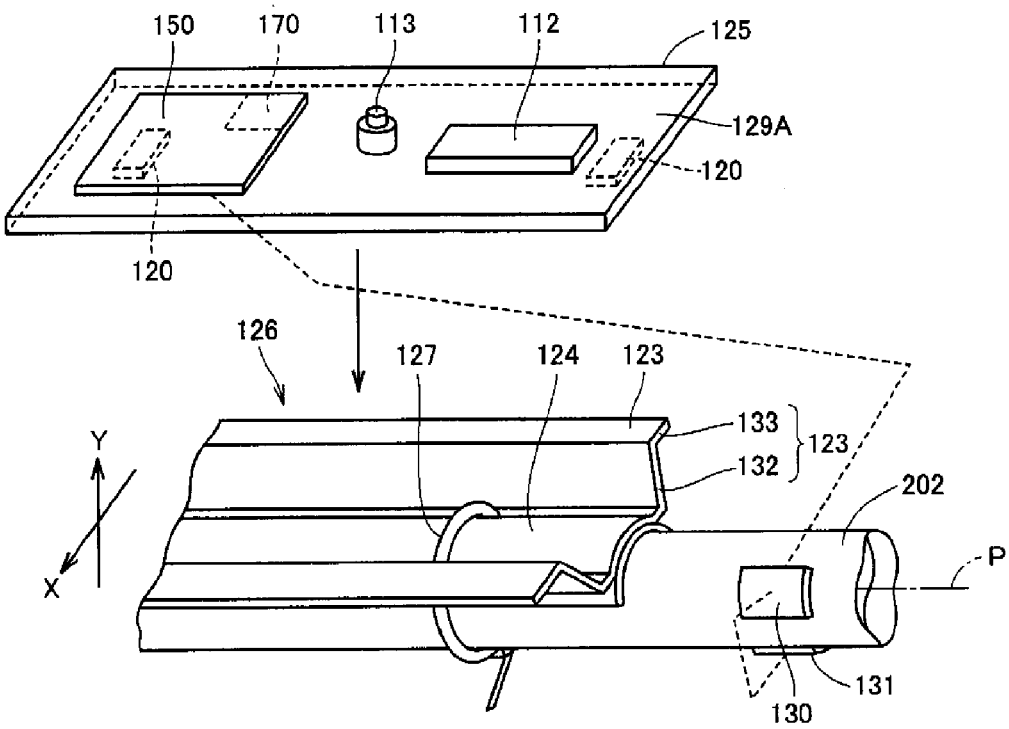
FIG. 8 is an exploded perspective view showing the inside of measuring device.

FIG. 7 is a cross-sectional view of measuring device 100, and FIG. 8 is an exploded perspective view of the inside of measuring device 100. As shown in FIGS. 7 and 8, measuring device 100 is mounted on a surface of shaft 202. Measuring device 100 is provided on a circumferential surface of shaft 202, and it includes, by way of example, an elastically deformable buffer member 128 formed, for example, of polyester, a board holding portion 126 fixed on shaft 202 by a band 127 with buffer member 128 interposed, and a board 125 fixed by a bolt on an upper surface of board holding portion 126.

Board holding portion 126 includes a curved portion 124 curved along the shape of outer surface of shaft 202 to receive shaft 202 and buffer member 128, and flat portions 123 provided continuous to sides of curved portion 124. Board 125 is fixed on flat portions 123. Side portion of flat portion 123 is held between upper and lower casings 115 and 116, and upper and lower casings 115 and 116 are fixed to each other by a bolt.

Figure 9:
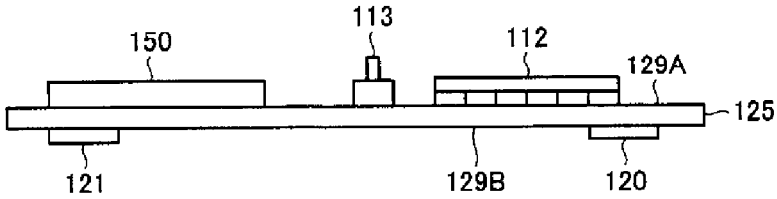
FIG. 9 is a side view of a board.

FIG. 9 is a side view of board 125. As shown in FIGS. 8 and 9, measuring device 100 includes acceleration sensors 120 and 121 attached to a main surface 129B of board 125 by means of solder or the like, a display unit 112 mounted on a main surface 129A of board 125, a processing unit 150 for performing various data processing, and a reset button 113. It is noted that acceleration sensors 120 and 121 are provided on main surface 129B that is opposite to the main surface 129A of board 125 on which built-in processing unit 150, display unit 112 and reset button 113 are provided.

To built-in processing unit 150, signals (output voltages) of strain gauges 130 and 131 are transmitted. It is noted that strain gauges 130 and 131 continuously transmit signals to built-in processing unit 150 at least from when the user starts a swing until the end of the swing. Specifically, the gauges transmit signals to built-in processing unit 150 from when power switch 114 is turned ON until it it turned OFF. Built-in processing unit 150 stores the output signals transmitted from strain gauges 130 and 131 in a storage unit 170.

Referring to FIGS. 10 to 13, a method of calculating "recommended kick point output value f" indicating the position of a bending point immediately before impact will be described.

Figure 10:
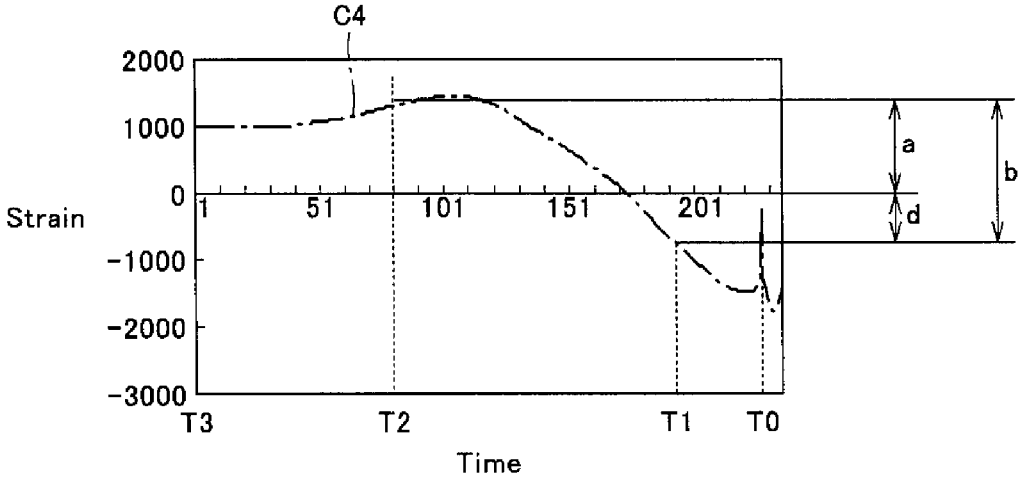
FIG. 10 is a graph representing result of calculation of the strain in the toe down direction at a position where the strain gauge is attached, based on an output voltage received by the processing unit from the strain gauge.

FIG. 10 is a graph representing results of calculation of strain in the toe down direction at a position where strain gauge 131 is attached, based on the output voltage received by built-in processing unit 150 from strain gauge 131. In the graph of FIG. 10, T0 represents the impact time point, and T3 represents the swing top time point. When the ratio of change in output voltage input from strain gauge 131 attains to a prescribe value or higher, built-in processing unit 150 determines the time point to be the impact time point.

A time point preceding impact time point T0 by, for example, 30 ms is used as a first detection time point T1, and a time point preceding impact time point T0 by, for example, 150 ms is used as a second detection time point T2. The first and second detection time points T1 and T2 are not limited to these values. The first detection time point T1 may be a time point of tens of ms after the impact time point T0, and the second detection time point T2 may be a time point one hundred and tens of ms thereafter. Specifically, the first detection time point T1 is set between a time point 10 ms before and a time point 100 ms before the detected impact time point T0, and the second detection time point T2 is set between a time point 100 ms before and a time point 200 ms before the detected impact time point T0. As a time point closer to the impact time point T0 is used as the first detection time point T1, an output value close to the output value of strain gauge 131 at the time of contact with the ball can be obtained. The time period between the first detection time point T1 and the impact time point T0 is shorter than the time period between the first and second detection time points T1 and T2.

Built-in processing unit 150 reads data stored in storage unit 170, and calculates amount of strain (−d) at the first detection time point T1 and calculates an amount of strain (a) at the second detection time point T2. Then, built-in processing unit 150 calculates the expected bending point value e based on Equation (1) below.

$$\text{(Expected bending point value: } e\text{)}=[\text{(amount of strain at second detection time point } T2\text{: } a)-\text{(amount of strain at first detection time point } T1\text{: } -d)]/\text{(amount of strain at second detection time point } T2\text{: } a)=(a+d)/a=b/a. \quad \text{Equation (1)}$$

Storage unit 170 stores recommended kick point output values f corresponding to various expected bending point values e, as shown in Table 1 below.

The expected bending point value e is a parameter indicating the state of shaft deformation in the toe down direction. Specifically, the smaller the value f of recommended shaft kick point, the larger the deformation at the tip end of the shaft, and the larger the value f of recommended shaft kick point, the larger the deformation at the gripping side of the shaft. The reason why the expected value e (=b/a) of bending point is related to the state of shaft deformation immediately before impact will be described later.

The recommended kick point output value f is one of the methods of display, which is set to make it easier to recognize the state of shaft deformation. The recommended kick point output value f is not limited to integers 0 to 9 shown in Table 1.

TABLE 1

| Recommended kick point output value f | Expected bending point value e |
|---|---|
| 0 | — |
| 1 | $0 \le e < 0.75$ |
| 2 | $0.75 \le e < 1.00$ |
| 3 | $1.00 \le e < 1.25$ |
| 4 | $1.25 \le e < 1.50$ |
| 5 | $1.50 \le e < 1.75$ |
| 6 | $1.75 \le e < 2.0$ |
| 7 | $2.0 \le e < 2.5$ |
| 8 | $2.5 \le e < 3.5$ |
| 9 | $3.5 \le e < 99$ |

After calculating the recommended kick point output value f, built-in processing unit 150 converts the calculated recommended kick point output value f using conversion data such as shown in Table 1, and outputs the result to display unit 112. Then, the recommended kick point output value f calculated by built-in processing unit 150 is input to external processing unit 502 of external support device 500 shown in FIG. 1. External processing unit 502 stores in its storage unit data that correspond to Table 2 below.

TABLE 2

| | Recommended kick point output value f | | |
|---|---|---|---|
| | 1-3 | 4-6 | 7-9 |
| Recommended kick point | Butt Soft (gripping side kick point) | Butt Standard (middle kick point) | Butt Stiff (tip kick point) |

Then, external processing unit 502 displays the kick point that corresponds to the input shaft kick point output value f, on external display unit 503.

Here, the relation between the expected bending point value e (recommended kick point output value f) and the state of shaft deformation will be described.

In order to accurately grasp the state of shaft deformation at the time of a swing by a user, it is possible, for example, to attach a plurality of strain gauges spaced apart from each other in the axial direction of the shaft, and to expect the bending point based on output values from the plurality of strain gauges.

Specifically, two strain gauges are attached with the central portion in the longitudinal direction of shaft 202 positioned therebetween. If the amount of strain detected by the strain gauge on the gripping side is larger than the amount of strain detected by the strain gauge on the head side, it is understood that the shaft 202 is bent larger on the gripping side than the central portion in the longitudinal direction of shaft 202. On the other hand, if the amount of strain detected by the strain gauge on the head side is larger than the amount of strain detected by the strain gauge on the gripping side, it is understood that the shaft is bent larger on the head side than at the central portion of the shaft.

Figure 11:
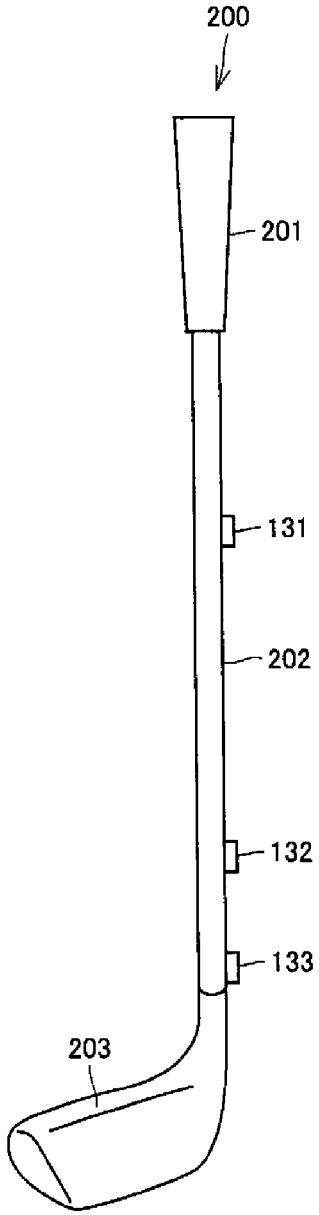
FIG. 11 is a perspective view of the golf club having three strain gauges attached spaced from each other in the axial direction of the shaft.

FIG. 11 is a perspective view of a golf club 200 on which three strain gauges 131, 132 and 133 are attached spaced from each other in the axial direction of shaft 202.

As shown in FIG. 11, strain gauge 131, strain gauge 133 provided at a tip end portion on the side of head 203 of shaft 202, and strain gauge 132 provided closer to the side of grip 201 by 20 cm from the tip end portion are attached on shaft 202. Strain gauges 131, 132 and 133 are all attached on shaft 202 such that strain in the toe down direction of shaft 202 can be measured.

Figure 12:
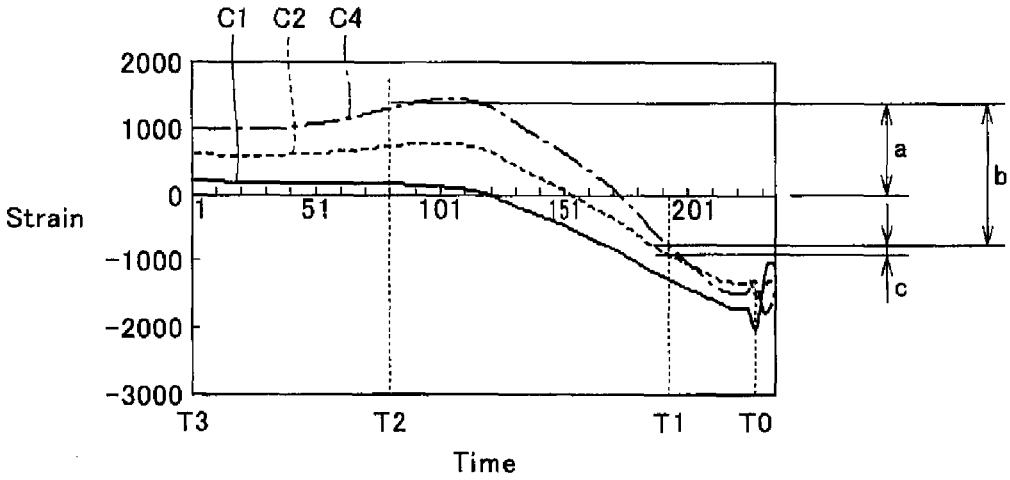
FIG. 12 is a graph representing various amounts of strain calculated based on strain gauge outputs from a top time point of a swing until after impact.

FIG. 12 is a graph representing amounts of strain calculated based on the outputs from strain gauges 131, 132 and 133 from the top of swing until after impact.

In FIG. 12, a curve C1 represents an output from strain gauge 131 provided at the tip end portion of shaft 202. A curve C2 represents an output of strain gauge 132 provided closer to the gripping side by 20 cm from the tip end portion of shaft 202. A curve C4 represents an output from strain gauge 131.

Based on the outputs of strain gauges 132 and 131 immediately before the impact, it is possible to grasp the bending point (position of maximum strain (peak position of bending) generated in the shaft by the user's swing) at 30 ms before the impact time point.

If the difference c between the amounts of strain detected by strain gauges 131 and 132 is positive, it is understood that the bending point is positioned on the tip end side (head 203) of shaft 202, and if the difference c is negative, it is understood that the bending point is positioned on the gripping side, as shown in Table 3 below.

TABLE 3

| | c | | |
|---|---|---|---|
| | Large | 0 | Small |
| Bending Point | Tip Side | ↔ | Butt side |

Specifically, by comparing the amounts of strain from stain gauge 131 provided closer to the gripping side than the central portion of shaft and from strain gauge 132 provided closer to the head 203 than the central portion of shaft, it is possible to accurately grasp the bending point.

Figure 13:
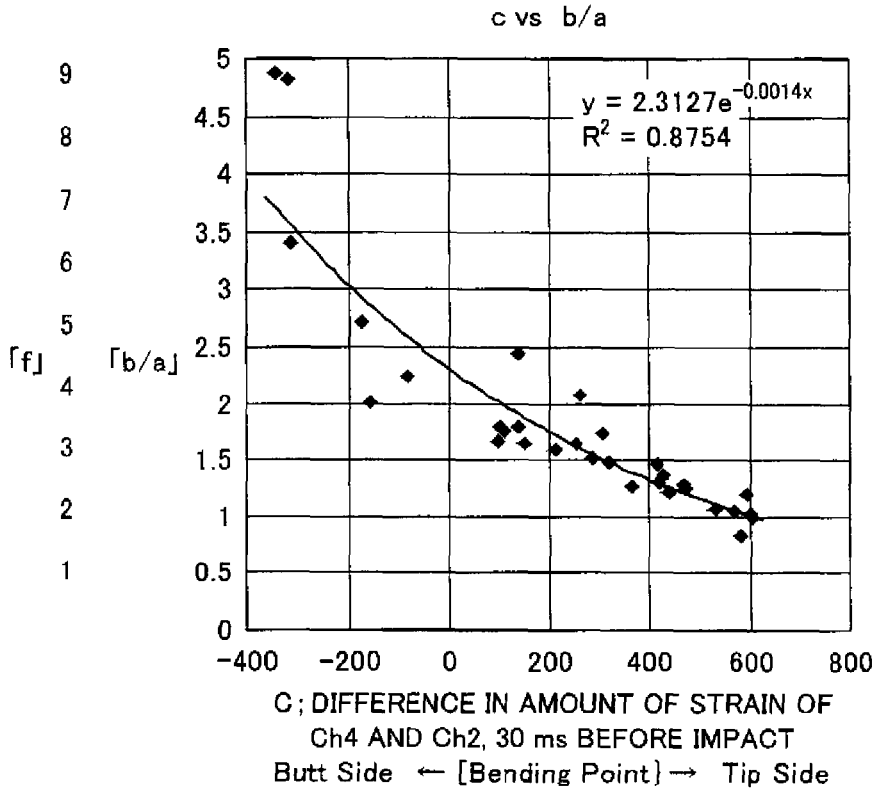

FIG. 13 is a graph representing correlation between the value b/a described above and the difference c between amounts of strain detected by strain gauges 131 and 132.

Referring to FIG. 13, a plurality of players tried golf club 200 having three strain gauges 131, 132 and 133 attached. Based on the output values of strain gauges 131, 132 and 133, the difference c and the value b/a were calculated, which are as plotted on the graph of FIG. 13.

As shown in FIG. 13, when we plot (b/a) on y and c on x, we can approximate R2 (coefficient of determination, square of correlation)=0.8754: y=2.3127e−0.0014x. Particularly in the range where "b/a" is not smaller than 0.75 and not larger than 2, very high correlation is observed between "c" and "a/b", as can be seen from FIG. 13.

It is understood that the difference c between the amount of strain detected by strain gauge 131 and the amount of strain detected by strain gauge 132 is highly correlated with the value b/a. Therefore, it is possible to accurately grasp the bending point during a swing, using the value b/a. The value b/a can be calculated using one strain gauge 131, and therefore, manufacturing cost of measuring device 100 can be reduced.

The swing tempo is determined by "transition speed" and "cock release strength," and it can be represented by the "amount of deflection" during a swing. If the swing tempo of a user is fast, the amount of deflection is naturally large, and during a swing, the amount of deflection of the shaft maximizes at the top point. Therefore, the "maximum amount of strain ϵmax" may be adopted as a parameter representing swing tempo. The user having faster swing tempo has larger "maximum amount of strain ϵmax." In measuring device 100 in accordance with the present embodiment, the "maximum amount of strain" of the shaft is used as the swing tempo of the user.

The method of calculating the maximum amount of strain of the shaft experienced during a swing will be described. In FIGS. 1 and 4, measuring device 100 includes strain gauges 131 and 130, and strain gauge 131 measures strain of shaft 202 in the toe down direction, while strain gauge 130 measures strain of shaft 202 in the ball flying direction.

Strain gauges 131 and 130 continuously output signals to built-in processing unit 150 from the start to the end of a swing, and the output results are all stored in storage unit 170.

Therefore, from the amount of strain (ϵy) in the toe down direction calculated by strain gauge 131 and from the strain (ϵx) in the ball flying direction calculated by strain gauge 130, the amount of strain (ϵ) of shaft 202 can be calculated, in accordance with Equation (2) below.

$$\epsilon=\sqrt{(\epsilon x)^2+(\epsilon y)^2} \qquad \text{Equation (2)}$$

Built-in processing unit 150 calculates amount of strain ϵ at each time point and stores the calculated values in storage unit 170. Then, it stores the maximum value of the amount of strain calculated in accordance with Equation (2) as the "maximum amount of strain ϵmax" in storage unit 170. In storage unit 170, "swing tempo output values" that correspond to the "maximum amount of strain ϵmax" are stored in advance, as shown in Table 4 below.

At the time of measurement, built-in processing unit 150 calculates the "maximum amount of strain ϵmax" based on the output values from strain gauges 130 and 131, and displays the swing tempo output value corresponding to the calculated "maximum amount of strain ϵmax" on display unit 112.

The swing tempo output value provided by measuring device 100 is input to external processing unit 502 of external support device 500.

TABLE 4

| Swing tempo output value | Strain ϵ (μ st) |
|---|---|
| 0 | — |
| 1 | $0 \le \epsilon < 660$ |
| 2 | $660 \le \epsilon < 925$ |
| 3 | $925 \le \epsilon < 1190$ |
| 4 | $1190 \le \epsilon < 1455$ |
| 5 | $1455 \le \epsilon < 1720$ |
| 6 | $1720 \le \epsilon < 1985$ |

TABLE 4-continued

| Swing tempo output value | Strain ϵ (μ st) |
|---|---|
| 7 | $1985 \le \epsilon < 2350$ |
| 8 | $2350 \le \epsilon < 2800$ |
| 9 | $2800 \le \epsilon$ |

External support device 500 determines flex of the shaft to be selected, in accordance with the input swing tempo output value and the head speed, which will be described later.

Here, the swing tempo output value that contributes to shaft selection is calculated from the outputs of strain gauges 130 and 131, and strain gauge 131 contributes to calculation of "swing tempo output value" and "recommended kick point output value f."

As described above, the output value from strain gauge 131 is also used when various parameters are calculated for selecting a shaft and, therefore, the number of components in measuring device 100 can be reduced.

Next, the method of calculating head speed immediately before impact will be described.

As shown in FIGS. 8 and 9, measuring device 100 includes acceleration sensors 120 and 121 provided spaced apart from each other in the axial direction of shaft 202.

Measuring device 100 calculates head speed immediately before impact, based on outputs from these two acceleration sensors 120 and 121.

Measuring device 100 in accordance with the present embodiment calculates the head speed, assuming that, when a golf player swings golf club 200, golf club 200 is, at each moment, in a uniform circular motion about a virtual center of rotation O positioned on the central axis P shown in FIG. 1. The vertical center of rotation O moves in accordance with the swing posture.

The time of impact of ball and head 203 is detected, and assuming that even at the time of impact, golf club 200 is in uniform circular motion about virtual center of rotation O, virtual speed of central point R of head 203 is calculated from each of accelerations detected by acceleration sensors 120 and 121. On the other hand, correlation between virtual speed of central point R calculated assuming that golf club 200 makes a circular motion and velocity (swing speed) of head 203 actually measured by other measuring device during the swing is calculated in advance, and a correction function for making equal or approximating the virtual speed to the actually measured speed is calculated. With the swing of golf player during measurement, the calculated virtual speed is corrected by the correction function, whereby head speed approximated to the actual value is calculated.

Referring to FIG. 1, the method of calculating the virtual speed will specifically be described. In FIG. 1, acceleration sensors 120 and 121 are arranged in the direction of central axis P, and spaced apart from each other by a sensor-to-sensor distance r3, in the direction of central axis P. Acceleration sensor 120 is mounted at a position spaced by a center line distance r2 from virtual rotation center O in the direction of central axis P. Further, acceleration sensor 121 is mounted at a position spaced by a center line distance r1 from the virtual rotation center O. The central point R of the face of head 203 and acceleration sensor 120 are spaced by a center line distance L in the direction of central axis P.

Assume that a golf player swings golf club 200. Let us represent angular velocity of golf club 200 at the time of impact here by ω. Further, acceleration detected by acceleration sensor 120 is represented by α2, and acceleration detected by acceleration sensor 121 by $\alpha 1$. Then, Equations (3) and (4) below are satisfied. Further, virtual speed Vh at central point R can be given by Equation (5).

$$\alpha 1 = r1 \times \omega^2 \quad \text{Equation (3)}$$

$$\alpha 2 = r2 \times \omega^2 = (r1 + r3) \times \omega^2 \quad \text{Equation (4)}$$

$$Vh = (L + r2) \times \omega \quad \text{Equation (5)}$$

By eliminating terms ω, r1 and r2 from Equations (3) to (5), virtual speed Vh can be given by Equation (6) below.

$$Vh = (L + r3 + \alpha 1 \times r3/(\alpha 2 - \alpha 1)) \times ((\alpha 2 - \alpha 1)/r3)^{1/2} \quad \text{Equation (6)}$$

Here, center line distance L and sensor-to-sensor distance r3 are determined by measuring device 100 and known values, and $\alpha$1 and $\alpha$2 can be measured by acceleration sensors 120 and 121, respectively.

Therefore, from the output values of acceleration sensors 120 and 121, virtual speed Vh can be calculated.

Figure 14:
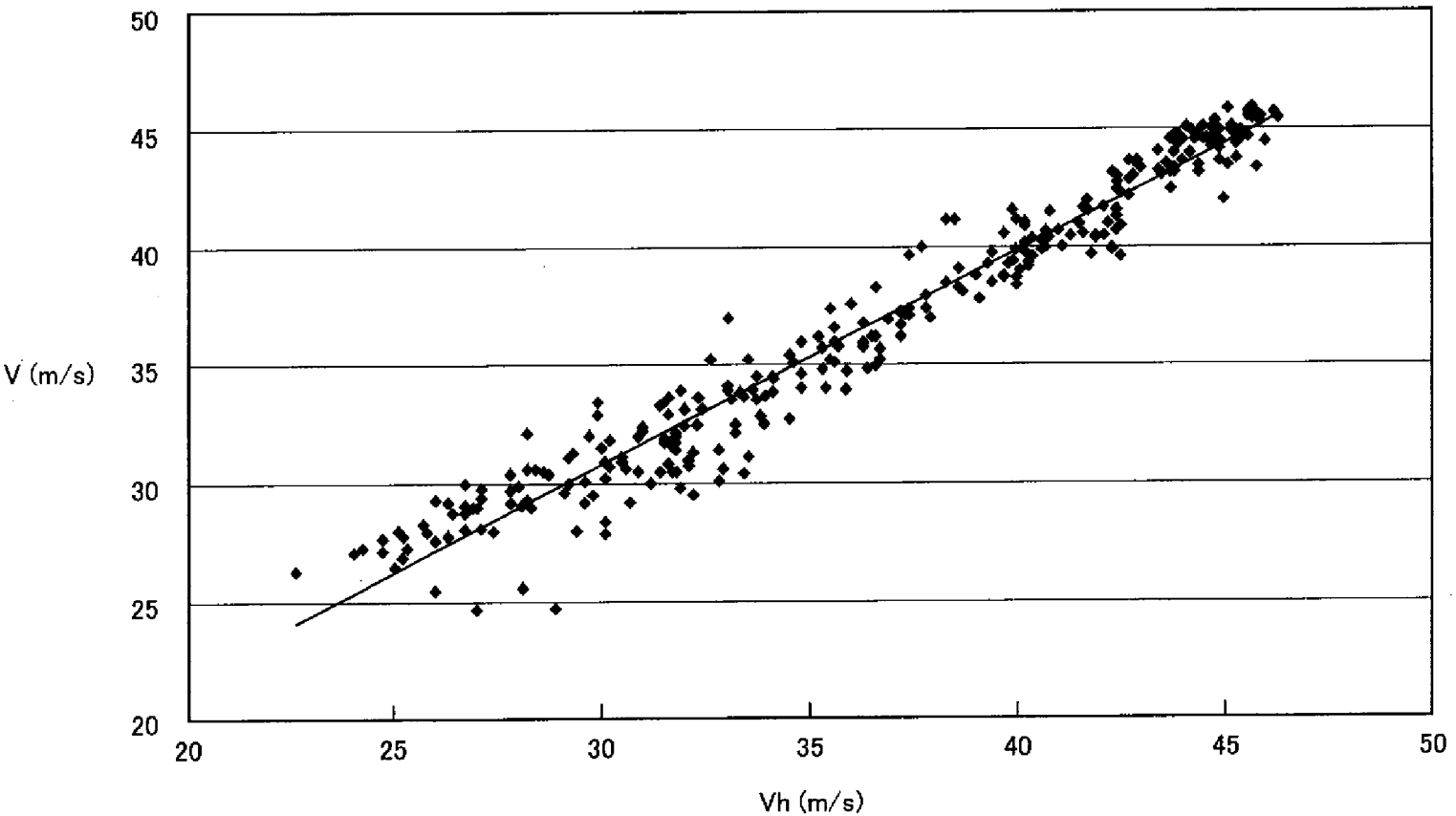
FIG. 14 represents correlation between virtual speed Vh and actually measured value.

FIG. 14 is a graph representing correlation between virtual speed Vh and the actually measured value. Referring to FIG. 14, a method of calculating a correction equation for approximating the virtual speed Vh to the actually measured value will be described. In the graph shown in FIG. 14, the abscissa represents actually measured velocity (swing speed) of central point R, while the ordinate represents virtual speed Vh calculated from Equation (6) based on output values from acceleration sensors 120 and 121.

As can be seen from FIG. 14, values (virtual speed Vh) calculated by inputting output values from acceleration sensors 120 and 121 during swings of golf club 200 to Equation (6) above, and actual values of the speed of central point R during the swings measured by a separate measuring device, are sampled. Then, as shown in FIG. 14, an approximate expression, as represented by Equation (7) below, is derived from the results. As to the measuring device for measuring the actual value, MAC-3D operation analysis system manufactured by Motion Analysis Corp., for example, may be used.

$$\text{Head speed } (V) = 0.9018 \times Vh + 3.7251 \quad \text{Equation (7)}$$

The approximate expression represented by Equation (7) is only an example and not limiting. Further, the method of approximation is not limited to linear approximation and it may be a quadratic approximation of polynomial approximation, logarithmic approximation or exponential approximation.

When the actual head speed is to be measured using measuring device 100 storing correction data (approximate expression) as represented by Equation (7) above, first, the impact time point is detected based on the outputs from acceleration sensors 120 and 121 or strain gauges 130 and 131.

Based on the outputs from acceleration sensors 120 and 121 immediately before impact, the virtual speed Vh is calculated and input to the approximation equation (7) above, whereby accurate head speed V immediately before impact can be calculated.

Here, "swing tempo output value" is calculated at built-in processing unit 150.

In external processing unit 502 of external support device 500 shown in FIG. 1, data for selecting flex of a shaft to be selected are stored, based on the calculated "swing tempo output values" and the calculated "head speed V."

Figure 15:
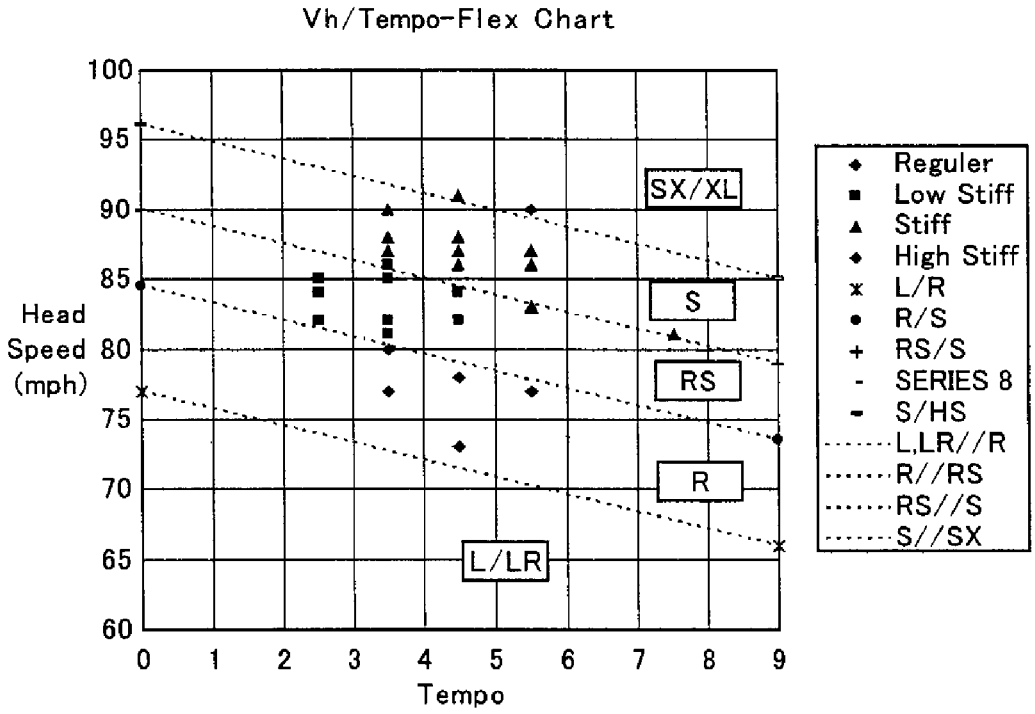
FIG. 15 shows, in a graph, data for obtaining flex of a shaft to be selected, based on the "swing tempo output value" and "head speed V", stored in an external processing unit.

FIG. 15 shows, in the form of a graph, data stored in external processing unit 502 for finding flex of the shaft to be selected, based on the "swing tempo output values" and the "head speed."

As shown in FIG. 15, based on the calculated head speed and the swing tempo output values, flex suitable for the user is selected. By way of example, for a user having slow head speed and small swing tempo output value, relatively soft L/LR flex or R flex is selected. On the other hand, for a user having high head speed and high swing tempo output value, relatively hard flex such as S flex or SX/XL flex is selected.

Measuring device 100 calculates the "toe down amount" and "kick angle" immediately before impact. External support device 500 calculates stiffness distribution (EI distribution) of the shaft suitable for the user based on the calculated "kick angle" and "toe down amount" and displays the result on the display unit.

Here, the "kick angle" is calculated from the amount of strain in the X direction (ball flying direction) detected by strain gauge 130. The "toe down amount" is detected by strain gauge 131. Measuring device 100 converts the amount of strain $\epsilon x$ in the ball flying direction detected by strain gauge 130 immediately before impact to a kick angle KA. The kick angle KA is an integer of 0 to 9. Similarly, measuring device 100 converts $\epsilon y$ in the toe down direction detected by strain gauge 131 to a toe down value TD. Toe down value TD is also an integer of 0 to 9.

Tables 5 and 6 below represent data stored in external processing unit 502 of external support device 500. Table 5 represents data for converting the amount of strain $\epsilon x$ to kick angle KA, and Table 6 represents data for converting the strain $\epsilon y$ to toe down value TD mentioned above. External processing unit 502 displays the kick angle KA and toe down value TD on display unit 112.

TABLE 5

| Kick angle KA | Strain $\epsilon x$ (μ st) |
|---|---|
| 0 | $\epsilon x < -299$ |
| 1 | $-299 \le \epsilon x < -135$ |
| 2 | $-135 \le \epsilon x < 29$ |
| 3 | $29 \le \epsilon x < 192$ |
| 4 | $192 \le \epsilon x < 356$ |
| 5 | $356 \le \epsilon x < 520$ |
| 6 | $520 \le \epsilon x < 683$ |
| 7 | $683 \le \epsilon x < 847$ |
| 8 | $847 \le \epsilon x < 1010$ |
| 9 | $1010 \le \epsilon x$ |

TABLE 6

| Toe down value TD | Strain $\epsilon y$ (μ st) |
|---|---|
| 0 | $\epsilon y < -179$ |
| 1 | $-179 \le \epsilon y < 88$ |
| 2 | $88 \le \epsilon y < 356$ |
| 3 | $356 \le \epsilon y < 624$ |
| 4 | $624 \le \epsilon y < 891$ |
| 5 | $891 \le \epsilon y < 1159$ |
| 6 | $1159 \le \epsilon y < 1427$ |
| 7 | $1427 \le \epsilon y < 1694$ |
| 8 | $1694 \le \epsilon y < 1962$ |
| 9 | $1962 \le \epsilon y$ |

External processing unit 502 of external support device 500 stores data for setting stiffness distribution (EI distribution) of the shaft based on the input "kick angle KA" and "toe down value TD." Specifically, the data represented by Table 7 below is stored.

TABLE 7

| | | KA | | | | | |
|---|---|---|---|---|---|---|---|
| | | 1-3 | | 4-6 | | 7-9 | |
| TD | 1-3 | Butt EI | ↓ | Butt EI | ↓ | Butt EI | ↓ |
| | | Tip EI | ↓ | Tip EI | → | Tip EI | ↑ |
| | 4-6 | Butt EI | → | Butt EI | → | Butt EI | → |
| | | Tip EI | ↓ | Tip EI | → | Tip EI | ↑ |
| | 7-9 | Butt EI | ↑ | Butt EI | ↑ | Butt EI | ↑ |
| | | Tip EI | ↓ | Tip EI | → | Tip EI | ↑ |

In Table 7 above, "→" means that the shaft stiffness is not changed from that on which measuring device 100 is attached, "↑" means the stiffness is increased, and "↓" means that the stiffness is decreased.

External processing unit 502 of external support device 500 stores data for selecting shaft mass based on the input swing speed. Table 8 represents the data for selecting shaft mass, which is stored in external processing unit 502.

TABLE 8

| Flex | Head Speed (mph) | Shaft Weight (g) |
|---|---|---|
| L, LR | Under 70 | Under 100 |
| | Over 70 | Under 100 |
| R | Under 75 | Under 105 |
| | 75 to 80 | 100 to 115 |
| | Over 80 | Over 110 |
| RS | Under 80 | Under 105 |
| | 80 to 85 | 100 to 115 |
| | Over 85 | Over 110 |
| S | Under 85 | Under 110 |
| | 85 to 90 | 105 to 120 |
| | Over 90 | Over 115 |
| X | Under 90 | Under 120 |
| | Over 90 | Over 115 |

Figure 16:
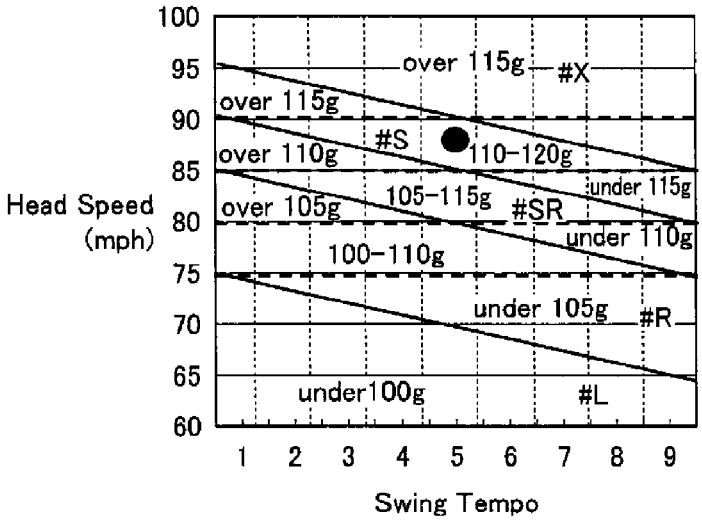
FIG. 16 shows a relation between shaft mass and head speed shown in Table 7, plotted over the graph of FIG. 15.

External processing unit 502 selects shaft mass based on the input head speed. FIG. 16 shows the relation between shaft mass and head speed shown in Table 7, plotted over the graph of FIG. 15.

As shown in the graph of FIG. 16, it is possible to select "shaft mass," "flex" and "kick point" based on the "swing tempo output value" and "head speed."

Further, measuring device 100 calculates the "deflection speed" in accordance with Equation 8 below.

In Equation 8, $\epsilon x(t0-26\text{ ms})$ means the amount of strain in the toe down direction 26 ms before the impact time point, and $\epsilon x(t0-6\text{ ms})$ means the amount of strain of the shaft in ball flying direction, at a time point 6 ms before the impact time point.

Generally, an average value of "deflection speed" of middle to high skilled golfers is about 2.5 m/s. If this value is excessively high, ball hitting direction becomes unstable. If it is too small, head speed at the time of impact lowers. Therefore, preferable "deflection speed" is, for example, from about 1.5 m/s to about 3.5 m/s.

$$\text{deflection speed } (\mu\text{st/s}) = \frac{\Delta\varepsilon}{\Delta t} = \frac{\varepsilon_x(t_0 - 26^{ms}) - \varepsilon_x(t_0 - 6^{ms})}{20^{ms}} \quad \text{Equation 8}$$

Built-in processing unit 150 converts the "deflection speed" calculated by Equation (8) above to a "deflection speed output value RF" represented by an integer of 0 to 9. Built-in processing unit 150 stores conversion data for converting the "deflection speed" to an integer of 0 to 9. Built-in processing unit 150 converts the "deflection speed" calculated from actual measurement to the "deflection speed output value RF," and display unit 112 displays the calculated deflection speed output value RF.

If the "deflection speed" is evaluated to be too high, the shaft is made harder (flex is increased). This reduces the "deflection speed" and prevents "variation of hitting points."

Figure 17:
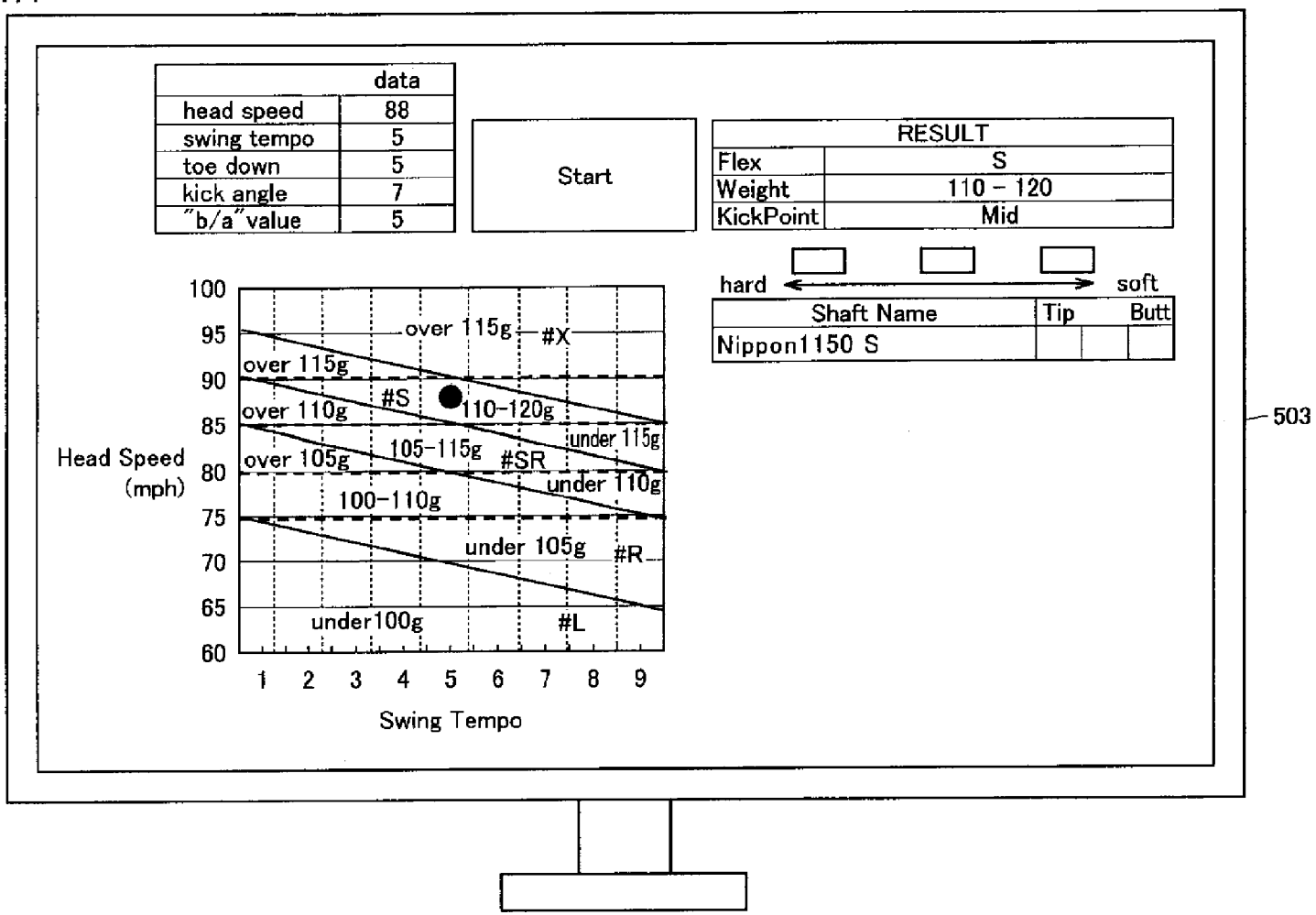
FIG. 17 is a front view of an external display unit, showing an operation image screen of an external support device.

FIG. 17 is a front view of an image on external display unit 503, representing an operation image of external support device 500. In the example shown in FIG. 17, head speed of "88", swing tempo value of "5", toe down value TD of "5", kick angle KA of "7" and (b/a) of "5" are input.

As a result, a shaft having the "flex" of "S", shaft mass of "110 to 120" and bending point of "Mid" is selected. Specifically, a shaft having the shaft name "Nippon 1150 S" is selected.

(Second Embodiment)

A golf club shaft selecting system in accordance with a second embodiment will be described with reference to FIG. 18.

Figure 18:
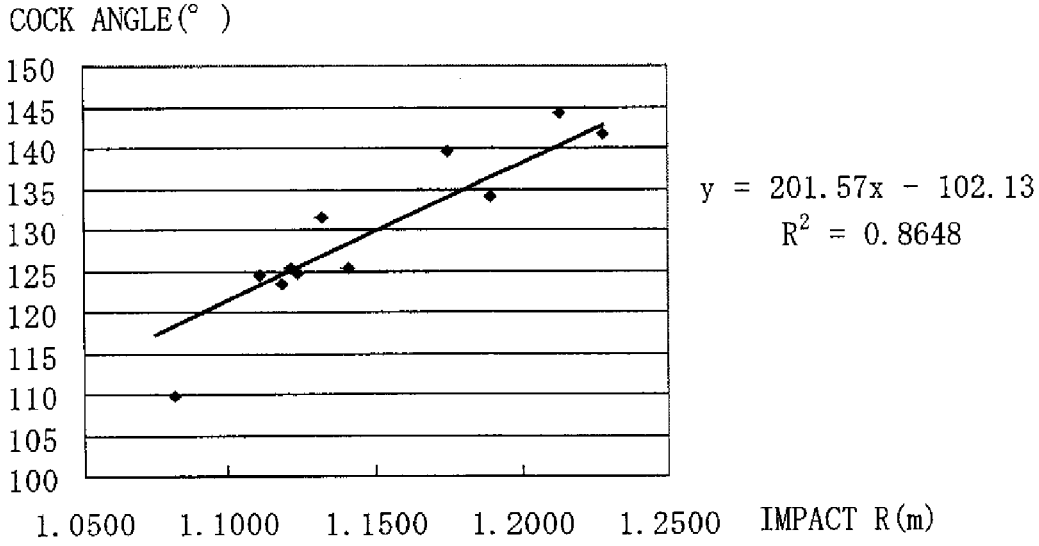
FIG. 18 is a graph representing a relation between cock angle and shaft rotation radius immediately before impact.

FIG. 18 is a graph showing a relation between cock angle and radius of rotation of the shaft immediately before impact. The cock angle refers to an angle formed by golf club 200 and the user's arm, at the wrist portion of the user.

Using an image pick-up device or the like, the cock angle immediately before impact when the user hits the ball is measured. The radius R of rotation of the shaft immediately before impact can be calculated from the head speed calculated by measuring device 100 and Equations (4) and (5) above. Sampled results are as plotted in FIG. 18.

When we represent the cock angle by y and the radius of rotation of shaft immediately before impact by x, the following approximation is possible: y=grip 201.57x−102.13:R2 (coefficient of determination, square of correlation)=0.8648.

Therefore, it is possible to calculate radius of rotation of shaft immediately before impact by measuring device 100, and to expect the cock angle of the user immediately before impact. Storage unit 170 stores the equation for calculating the cock angle from head speed or corresponding data. Built-in processing unit 150 calculates the cock angle immediately before impact, based on the calculated head speed. Then, display unit 112 displays the calculated cock angle.

In golf club selecting system 600, based on the head speed measured by measuring device 100 the radius of rotation of the shaft is calculated. Based on the calculated radius of rotation, shaft mass and flex to be recommended to the user are set.

Although the present invention has been described and illustrated in detail, it is clearly understood that the same is by way of illustration and example only and is not to be taken by way of limitation, the scope of the present invention being interpreted by the terms of the appended claims.

The present invention is applicable to a swing analyzer and a golf club shaft selecting system, and it is particularly suitable for a swing analyzer and a golf club shaft selecting system supporting selection of kick point optimal for the user.

What is claimed is:

1. A swing analyzer capable of outputting information usable for analyzing a swing of a user swinging a golf club including a shaft extending in a longitudinal direction and a head portion provided at one end of said shaft, comprising:

a toe down strain gauge provided on the shaft of said golf club and capable of measuring strain in toe down direction of said shaft;

a built-in processing unit calculating an expected bending point value corresponding to a position of bending point of said shaft; and a built-in display unit capable of displaying an output value from said built-in processing unit; wherein said built-in processing unit calculates said expected bending point value based on a measured value of said toe down strain gauge at a first time point during a swing of the user and on a measured value of said toe down strain gauge at a second time point preceding said first time point;

said built-in processing unit stores in advance conversion data for converting said expected bending point value to recommended kick point output value;

said recommended kick point output value is an output value representing the expected bending point value of said shaft;

said built-in processing unit outputs said recommended kick point output value corresponding to said calculated expected bending point value to said built-in display unit; and said toe down strain gauge is provided between a position of 304 mm and a position of 381 mm from said other end of said shaft.

2. A swing analyzer capable of outputting information usable for analyzing a swing of a user swinging a golf club including a shaft extending in a longitudinal direction and a head portion provided at one end of said shaft, comprising:

a toe down strain gauge provided on the shaft of said golf club and capable of measuring strain in toe down direction of said shaft;

a built-in processing unit calculating an expected bending point value corresponding to a position of bending point of said shaft; and a built-in display unit capable of displaying an output value from said built-in processing unit; wherein said built-in processing unit calculates said expected bending point value based on a measured value of said toe down strain gauge at a first time point during a swing of the user and on a measured value of said toe down strain gauge at a second time point preceding said first time point;

said built-in processing unit stores in advance conversion data for converting said expected bending point value to recommended kick point output value;

said recommended kick point output value is an output value representing the expected bending point value of said shaft;

said built-in processing unit outputs said recommended kick point output value corresponding to said calculated expected bending point value to said built-in display unit;

said toe down strain gauge continuously outputs measured values to said built-in processing unit;

said built-in processing unit detects a time point at which ratio of fluctuation of measured values continuously output from said toe down strain gauge exceeds a prescribed value, as an impact time point; and said built-in processing unit sets said first time point between time points 10 ms before and 100 ms before said detected impact time point, and sets said second time point between time points 100 ms before and 200 ms before said detected impact time point.

3. A swing analyzer capable of outputting information usable for analyzing a swing of a user swinging a golf club including a shaft extending in a longitudinal direction and a head portion provided at one end of said shaft, comprising:

a toe down strain gauge provided on the shaft of said golf club and capable of measuring strain in toe down direction of said shaft;

a ball flying direction strain gauge capable of detecting strain of said shaft in a ball flying direction;

a built-in processing unit calculating an expected bending point value corresponding to a position of bending point of said shaft; and a built-in display unit capable of displaying an output value from said built-in processing unit; wherein said built-in processing unit calculates said expected bending point value based on a measured value of said toe down strain gauge at a first time point during a swing of the user and on a measured value of said toe down strain gauge at a second time point preceding said first time point;

said built-in processing unit stores in advance conversion data for converting said expected bending point value to recommended kick point output value;

said recommended kick point output value is an output value representing the expected bending point value of said shaft;

said built-in processing unit outputs said recommended kick point output value corresponding to said calculated expected bending point value to said built-in display unit;

said built-in processing unit calculates maximum amount of strain of said shaft based on a measured value of said ball flying direction strain gauge and on a measured value from said toe down strain gauge;

said built-in processing unit stores conversion data for converting the maximum amount of strain of said shaft to a swing tempo output value indicating swing tempo of the user; and said built-in processing unit calculates said swing tempo output value based on the calculated maximum amount of strain, and said built-in display unit displays the calculated swing tempo output value.

* * * * *